US010100459B2

(12) United States Patent
Groppel

(10) Patent No.: US 10,100,459 B2
(45) Date of Patent: Oct. 16, 2018

(54) FLEXIBLE DRYING SOLUTION FOR DELIVERING CLOTHING CARE EXTERNALLY OF A DRYING APPLIANCE

(71) Applicant: WHIRLPOOL CORPORATION, Benton Harbor, MI (US)

(72) Inventor: Stephen M. Groppel, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/400,337

(22) Filed: Jan. 6, 2017

(65) Prior Publication Data

US 2018/0195228 A1 Jul. 12, 2018

(51) Int. Cl.
*D06F 58/20* (2006.01)

(52) U.S. Cl.
CPC ..... *D06F 58/20* (2013.01)

(58) Field of Classification Search
CPC ..... D06F 58/20
USPC ..... 34/595–610; 68/5 C, 19
See application file for complete search history.

(56) References Cited

U.S. PATENT DOCUMENTS 2,617,203 A 11/1952 Murray
3,197,886 A 8/1965 Brame et al.
3,889,392 A 6/1975 Davis et al.
4,819,341 A * 4/1989 Gayso ..... D06F 58/10 34/621
4,908,959 A 3/1990 Kretchman et al.
D314,262 S 1/1991 Kretchman et al.
5,535,478 A * 7/1996 Thompson ..... A47L 9/02 15/395
5,675,908 A * 10/1997 Barnes ..... D06F 58/22 342/233
5,904,160 A * 5/1999 Wright ..... A47L 5/24 134/21
6,038,732 A * 3/2000 McKnight ..... A47L 9/02 15/321
6,067,723 A * 5/2000 Lafrenz ..... D06F 58/04 34/106
6,481,047 B1 * 11/2002 Schaefer ..... A47L 7/00 15/314
6,604,298 B2 8/2003 Tomasi et al.
7,325,332 B2 * 2/2008 Chung ..... D06F 58/22 34/602
7,552,545 B2 6/2009 Crawford et al.
7,658,804 B1 * 2/2010 Cano ..... B08B 9/0436 134/8
7,913,419 B2 * 3/2011 Tomasi ..... D06F 29/00 211/85.3
8,001,650 B2 * 8/2011 Trotter ..... A47L 5/38 15/314
8,056,254 B2 * 11/2011 Loffler ..... D06F 58/24 34/134
8,347,523 B2 1/2013 Chung
8,650,773 B2 2/2014 Ackermann et al.
(Continued)

*Primary Examiner* — Stephen M Gravini
(74) *Attorney, Agent, or Firm* — Price Heneveld LLP

(57) ABSTRACT

An external accessory attachment for a drying appliance includes a housing defining a drying space. A suction attachment extends from the housing and is adapted to fit within a filter slot of the drying appliance. The suction attachment is capable of accepting airflow. A blocking flange is adapted to redirect an airflow path of the drying appliance through the housing and the suction attachment.

20 Claims, 9 Drawing Sheets

(56) References Cited

U.S. PATENT DOCUMENTS

| | | | | |
|---|---|---|---|---|
| 8,713,813 | B2 * | 5/2014 | Sans Rovira | D06F 58/22 134/42 |
| 8,739,433 | B2 | 6/2014 | Da Riol et al. | |
| 9,695,545 | B2 * | 7/2017 | Goble | A47L 9/00 |
| 9,816,756 | B2 * | 11/2017 | Paderno | F26B 21/086 |
| 9,845,567 | B2 * | 12/2017 | Contarini | D06F 58/24 |
| 9,850,614 | B2 * | 12/2017 | Chiriatti | D06F 37/20 |
| 2009/0172965 | A1 | 7/2009 | Campagnolo et al. | |
| 2009/0235549 | A1 * | 9/2009 | Cartwright | D06F 58/00 34/92 |

* cited by examiner

FLEXIBLE DRYING SOLUTION FOR DELIVERING CLOTHING CARE EXTERNALLY OF A DRYING APPLIANCE

FIELD OF THE DEVICE

The device is in the field of drying appliances, and more specifically, an attachment that can be externally connected to a drying appliance for providing clothing care external to the drying appliance.

SUMMARY

In at least one aspect, an external accessory attachment for a drying appliance includes a housing defining a drying space. A suction attachment extends from the housing and is adapted to fit within a filter slot of the drying appliance. The suction attachment is capable of accepting airflow. A blocking flange is adapted to redirect an airflow path of the drying appliance through the housing and the suction attachment.

In at least another aspect, a drying attachment for external use in conjunction with a front load drying appliance has an externally accessible and removable filter member. The drying attachment selectively replaces the filter member during operation. The drying attachment includes a housing defining a drying space and a suction attachment having an integral blocking flange extending from a bottom of the housing. The suction attachment allows airflow through the drying space. The suction attachment is configured to channel air through the drying space and towards a blower disposed in the front loading drying appliance.

In at least another aspect, a method of operating an externally mounted drying attachment in conjunction with a drying appliance includes removing a filter member from an externally accessible filter slot, the filter slot being in an airflow path of the drying appliance. The drying attachment is positioned proximate the filter slot. The drying attachment has a drying space and a suction attachment. The suction attachment is disposed into the externally accessible filter slot in the airflow path. A blocking flange is positioned to redirect an airflow path of the drying appliance to be through the drying space and through an air outlet of the drying appliance. A blower of the drying appliance is activated to direct air through the drying space and the suction attachment and out the air outlet via the airflow path.

These and other features, advantages, and objects of the present device will be further understood and appreciated by those skilled in the art upon studying the following specification, claims, and appended drawings.

DETAILED DESCRIPTION OF EMBODIMENTS

Figure 1:
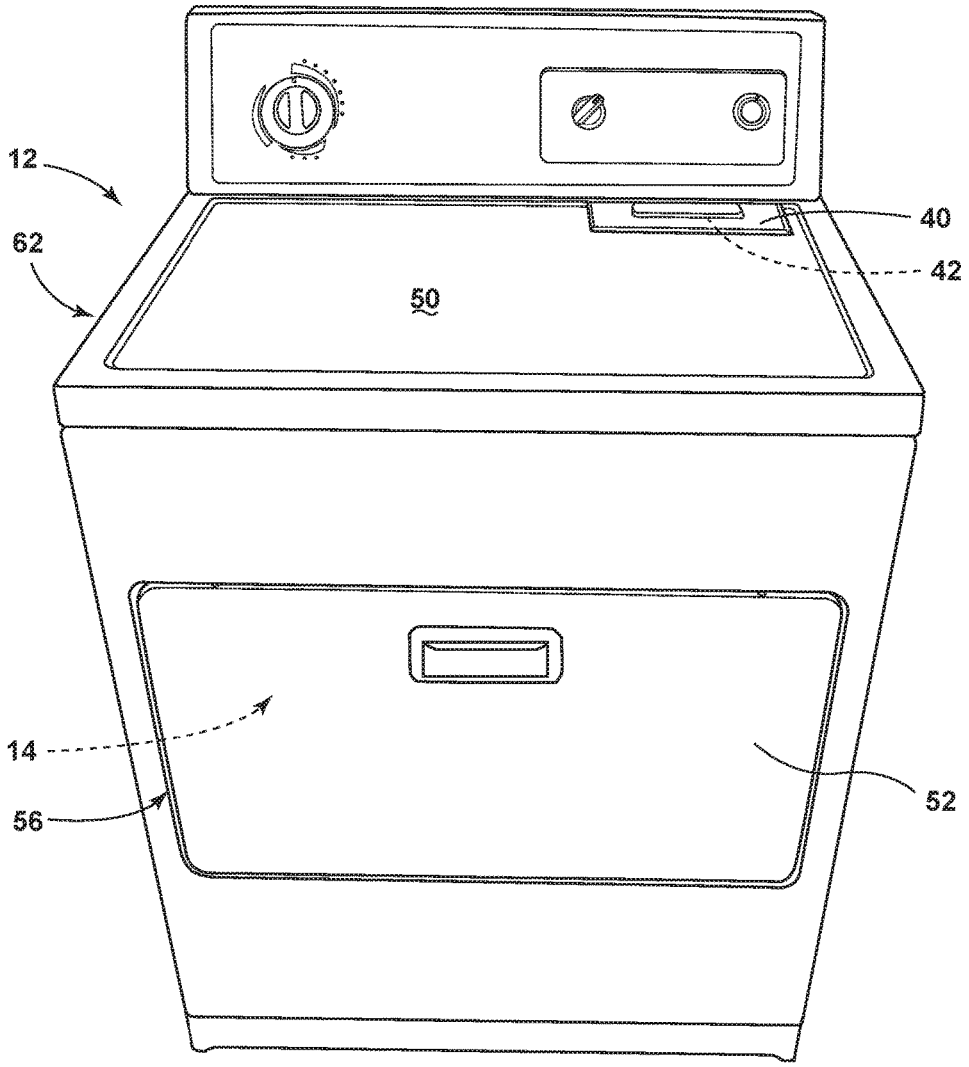
FIG. 1 is a front perspective view of a drying appliance that is adapted to receive an aspect of the external accessory attachment.
Figure 2:
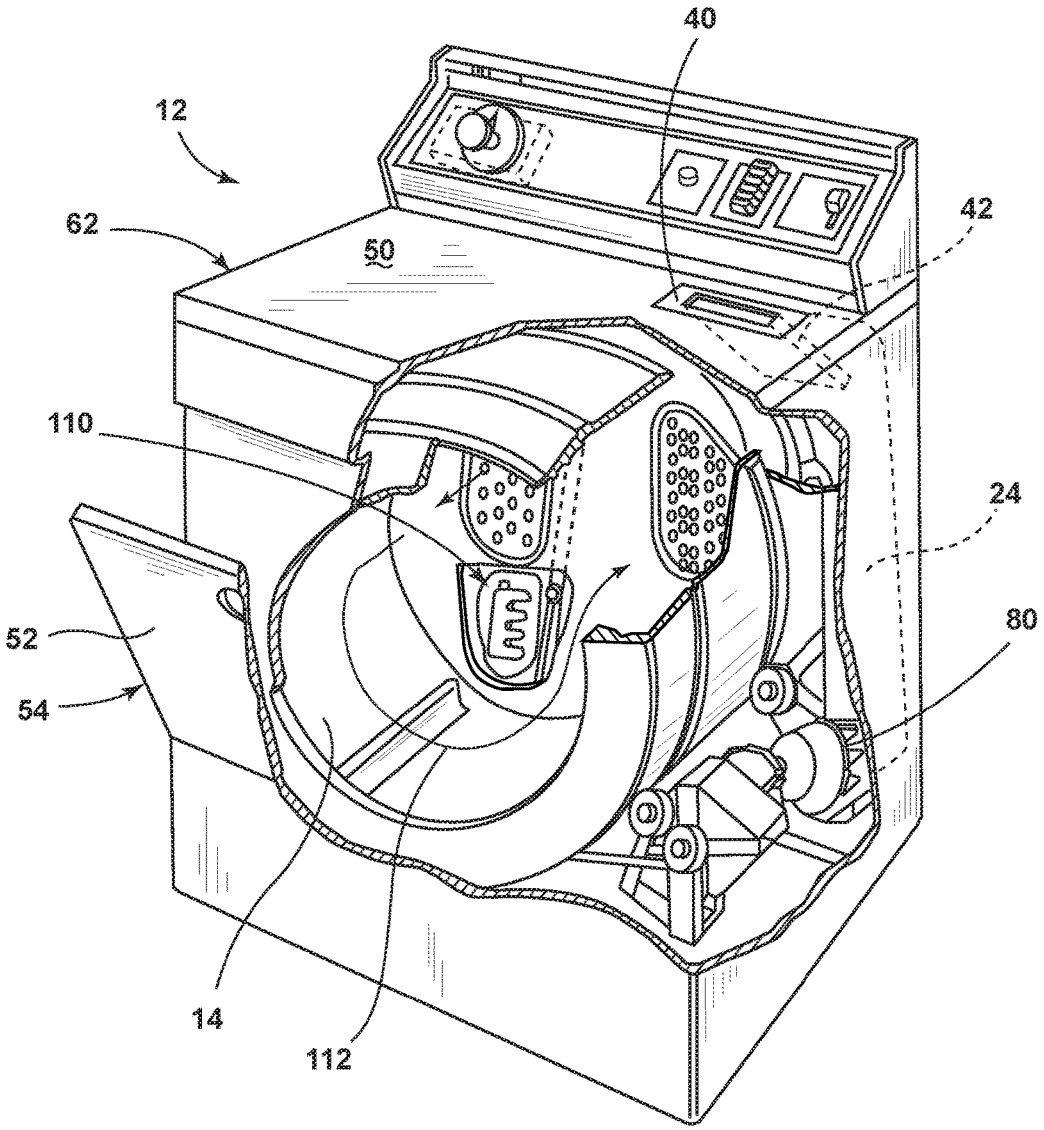
FIG. 2 is a partially cut-away perspective view of the drying appliance of FIG. 1.
Figure 3:
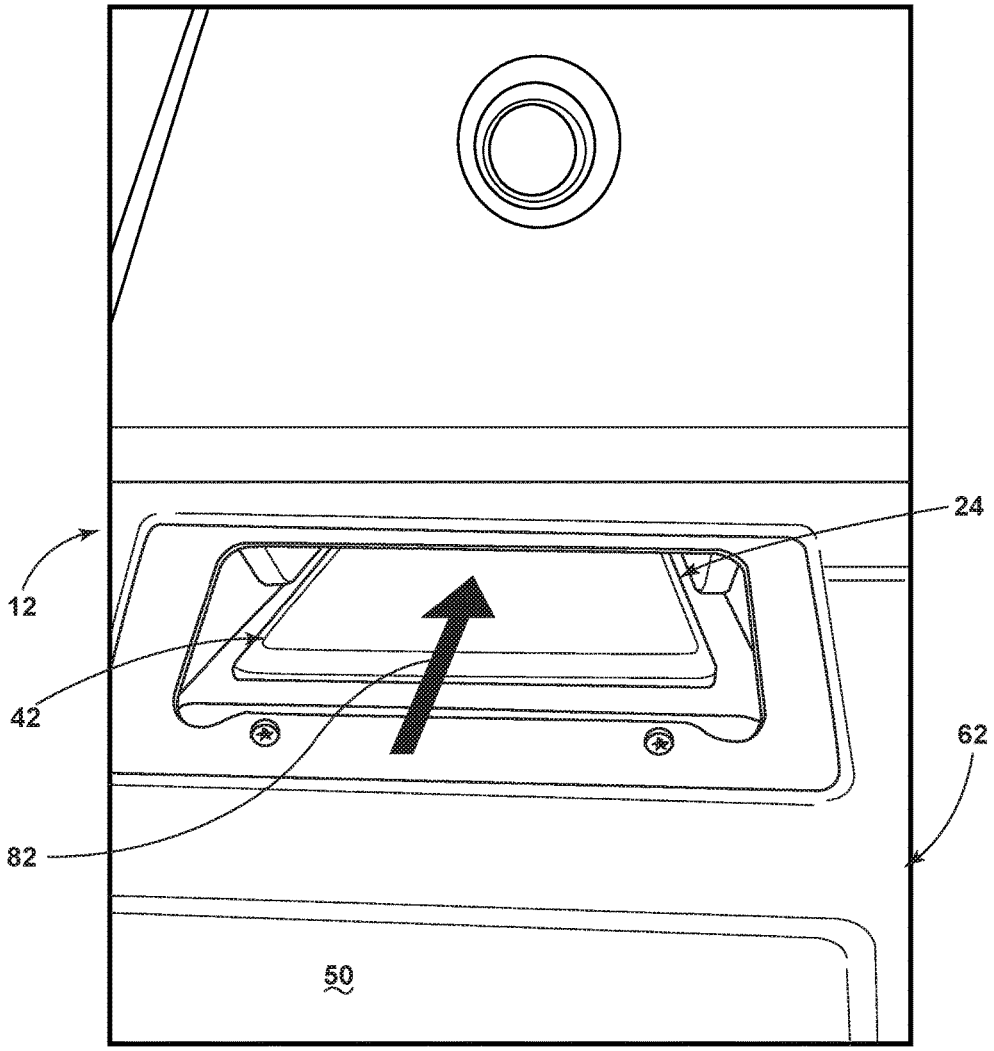
FIG. 3 is a top perspective view of the drying appliance of FIG. 2 showing the filter removed and viewing the interior of the filter slot.
Figure 4:
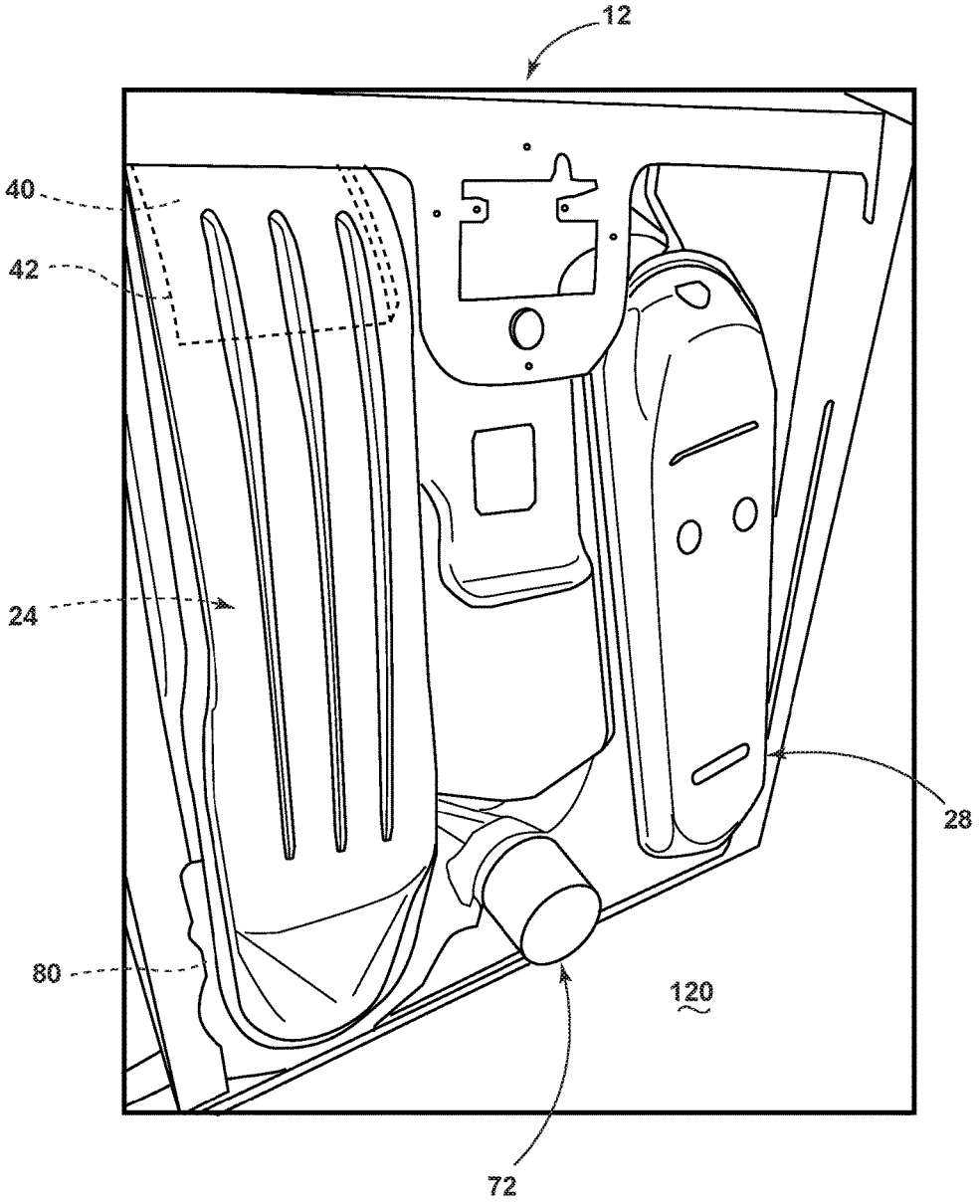
FIG. 4 is a rear perspective view of the drying appliance of FIG. 2.
Figure 5:
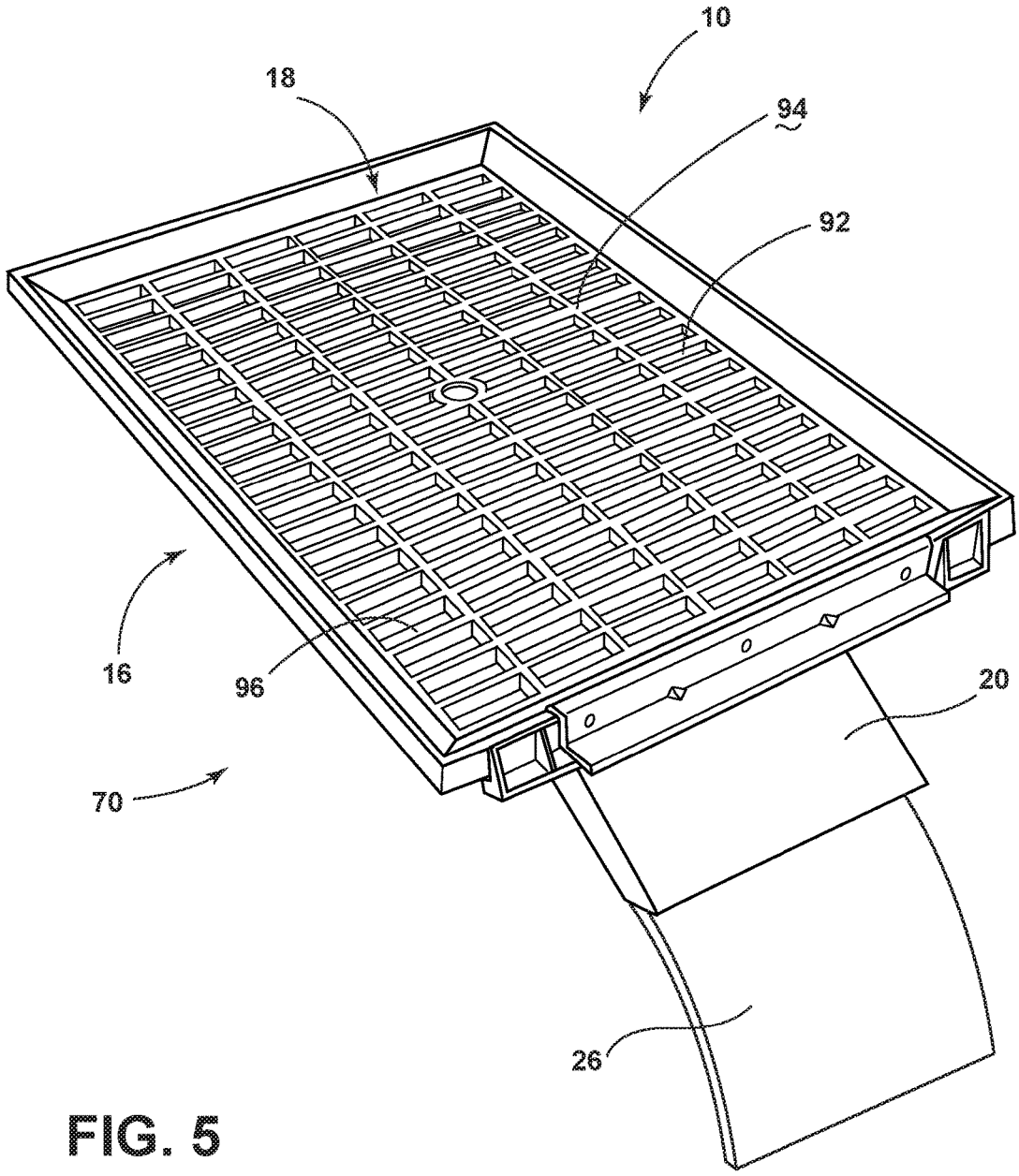
FIG. 5 is a top perspective view of an aspect of the external accessory attachment.

The present disclosure sets forth a drying accessory that can be attached to a conventional dryer in order to dry selected laundry items outside of the dryer. Consumers often choose to dry certain garments outside of a conventional dryer for a variety of reasons, including because they want to prevent damage to delicate items (e.g., delicate nightwear), because certain items are too bulky to fit inside a conventional dryer (e.g., coats), because certain items would make too much noise if dried inside a conventional dryer (e.g., boots), or because certain items are otherwise too cumbersome to dry in a conventional dryer. In these situations, consumers may simply hang the laundry to dry in ambient air, but that approach takes a substantial amount of time. Other solutions, such as drying cabinets or stand-alone specialty dryers, take up space and are unduly expensive.

By way of summary, the present disclosure sets forth an external accessory attachment 10 that can be used to dry laundry outside of a drying appliance 12. The external accessory attachment 10 sits on top of a drying appliance 12 and includes an upper surface 94 on which clothing can be placed for drying. The external accessory attachment 10 connects to the drying appliance 12 via a filter slot 42 located on the drying appliance 12. The consumer can remove a filter member 40 that normally would occupy the filter slot 42, and insert a suction attachment 20 protruding from the external accessory attachment 10 in its place. Based on the manner in which the suction attachment 20 couples to the filter slot 42, heated air generated by the drying appliance 12 can be routed through airflow channels 92 on the upper surface 94 to expose the clothing to airflow. Depending on the implementation, the airflow may or may not be heated, as will be explained below.

In one exemplary implementation to be discussed below, the external accessory attachment 10 provides a rack-style upper surface 94 for clothing. Other embodiments to be disclosed below include hanger-style accessory attachments. Still other embodiments provide ways to enhance the laundry being dried with the external accessory attachment 10, including refreshing treatments, fragrance treatments, static removal treatments, and others.

The external accessory attachment 10 is suitable for delicate clothing because it dries garments on rack-style surfaces or on hangers, avoiding the harsh mechanical action of a conventional dryer's rotating drum. The external accessory attachment 10 takes up little space because it fits directly on top of, and couples to, an existing drying appliance 12. And the external accessory attachment 10 has low cost because it leverages the existing airflow and heater mechanisms of the existing drying appliance 12.

In more detail, and as illustrated in FIGS. 1-6, reference numeral 10 generally refers to an external accessory attachment that can be used in conjunction with a drying appliance 12 for drying and otherwise providing fabric care in an area external to the drying appliance 12. According to the various embodiments, the external accessory attachment 10 includes a housing 16 that provides a drying space 18. A suction attachment 20 extends from the housing 16 and provides an airflow connection between the drying space 18 and the drying appliance 12. When the suction attachment 20 is in an engaged position 22, an airflow path 24 of the drying appliance 12 is redirected through the drying space 18. In particular, a blocking flange 26 selectively obstructs the airflow path 24 in the engaged position 22. In this manner, the blocking flange 26 in the engaged position 22 serves to redirect the airflow path 24 to be through the housing 16 and the suction attachment 20. Thus, the airflow path 24 is redirected such that air enters the airflow path 24 through the drying space 18 and the suction attachment 20. In the engaged position 22, the airflow path 24 is at least partially redirected away from an air intake 28 of the drying appliance 12 or the rotating drum 14 of the drying appliance 12.

Referring again to FIGS. 1-6, in the engaged position 22, the suction attachment 20 and the blocking flange 26 selectively replaces a filter member 40 that would normally occupy a filter slot 42 within the airflow path 24. In this manner, a user can insert the external accessory attachment 10 after removing the filter member 40 from the filter slot 42. The suction attachment 20 can then be inserted into the filter slot 42. Accordingly, the suction attachment 20 and blocking flange 26 are positioned within the filter slot 42 and serve to place the suction attachment 20 in communication with the airflow path 24. This, in turn, redirects the airflow path 24 to allow for entry of accessory air 44 through the drying space 18 and the suction attachment 20, and into the airflow path 24 of the drying appliance 12.

The blocking flange 26, like the filter member 40, is adapted to cover an outlet portion of the rotating drum 14. While the filter member 40 allows process air 112 to pass therethrough, the blocking flange 26 covers this portion of the drum 14 to block process air 112 from leaving the drum 14 so that the airflow path 24 is redirected to allow accessory air 44 to enter through the external accessory attachment 10.

Referring again to FIGS. 2-6, the blocking flange 26 may be integral with the suction attachment 20. In such an embodiment, the blocking flange 26 forms at least a portion of the suction attachment 20. Accordingly, insertion of the suction attachment 20 into the filter slot 42 places the suction attachment 20 in communication with the airflow path 24 and also redirects the airflow path 24 to allow for the addition of accessory air 44 to the airflow path 24 for operating the external accessory attachment 10.

The suction attachment 20 and the blocking flange 26 are inserted into the filter slot 42 to define the engaged position 22. Because the suction attachment 20 is inserted through the filter slot 42 positioned on the top surface 50 of the drying appliance 12, the suction attachment 20 of the external accessory attachment 10 can be attached to the filter slot 42 without opening the front door 52 of the drying appliance 12, which is convenient for a user. And because the external accessory attachment 10 rests on the top surface 50 of the drying appliance 12, there is no need to open the front door 52 of the drying appliance 12 in order to position the external accessory attachment 10 in the engaged position 22, which is also convenient for a user.

Referring again to FIGS. 2-6, the external accessory attachment 10 can include one or more feet 60 that rest on the top surface 50 of the drying appliance 12. These feet 60 can include a non-slip material, such as a rubberized material, various polymers, composite materials, combinations thereof and other similar non-slip materials that assist in positioning the external accessory attachment 10 on the drying appliance 12 for use. The external accessory attachment 10 can also include one or more latching mechanisms that serve to attach the external accessory attachment 10 to a top portion 62 of the drying appliance 12.

Referring again to FIGS. 1-6, when the external accessory attachment 10 is in an unengaged position 70, the airflow path 24 of the drying appliance 12 can be directed sequentially through the drying appliance 12 from the air inlet 138, through the rotating drum 14, through the filter disposed within the filter slot 42 and then out of the drying appliance 12 through an air outlet 72. When the external accessory attachment 10 is coupled with the filter slot 42 such that the suction attachment 20 is disposed within the filter slot 42, the airflow path 24 is redirected. This redirected airflow path 24 allows for accessory air 44 to pass through the drying space 18 and into the drying appliance 12 through the suction attachment 20. Once the accessory air 44 passes through the suction attachment 20, it is moved through the remainder of the airflow path 24 downstream of the filter slot 42 and through the air outlet 72 to be delivered to an area external of the appliance 12, and, typically, external of the structure within which the drying appliance 12 is positioned.

Referring again to FIGS. 1-6, in order to move the drying air and/or the accessory air 44 through the airflow path 24, a blower 80 is disposed within the airflow path 24 for providing for the movement of air. Typically, the blower 80 is positioned downstream of the filter slot 42 to draw the process air 112 or accessory air 44 from the filter slot 42. In such an embodiment, attachment of the external accessory attachment 10 in the engaged position 22 allows for the redirection of the airflow path 24. In the engaged position 22, the blower 80 of the airflow path 24 generates suction 82 to draw accessory air 44 from the drying space 18 of the external accessory attachment 10. Accordingly, the blower 80 generates sufficient suction 82 through the drying space 18 and into the suction attachment 20 such that the accessory air 44 can be delivered into the airflow path 24 of the drying appliance 12.

Figure 6:
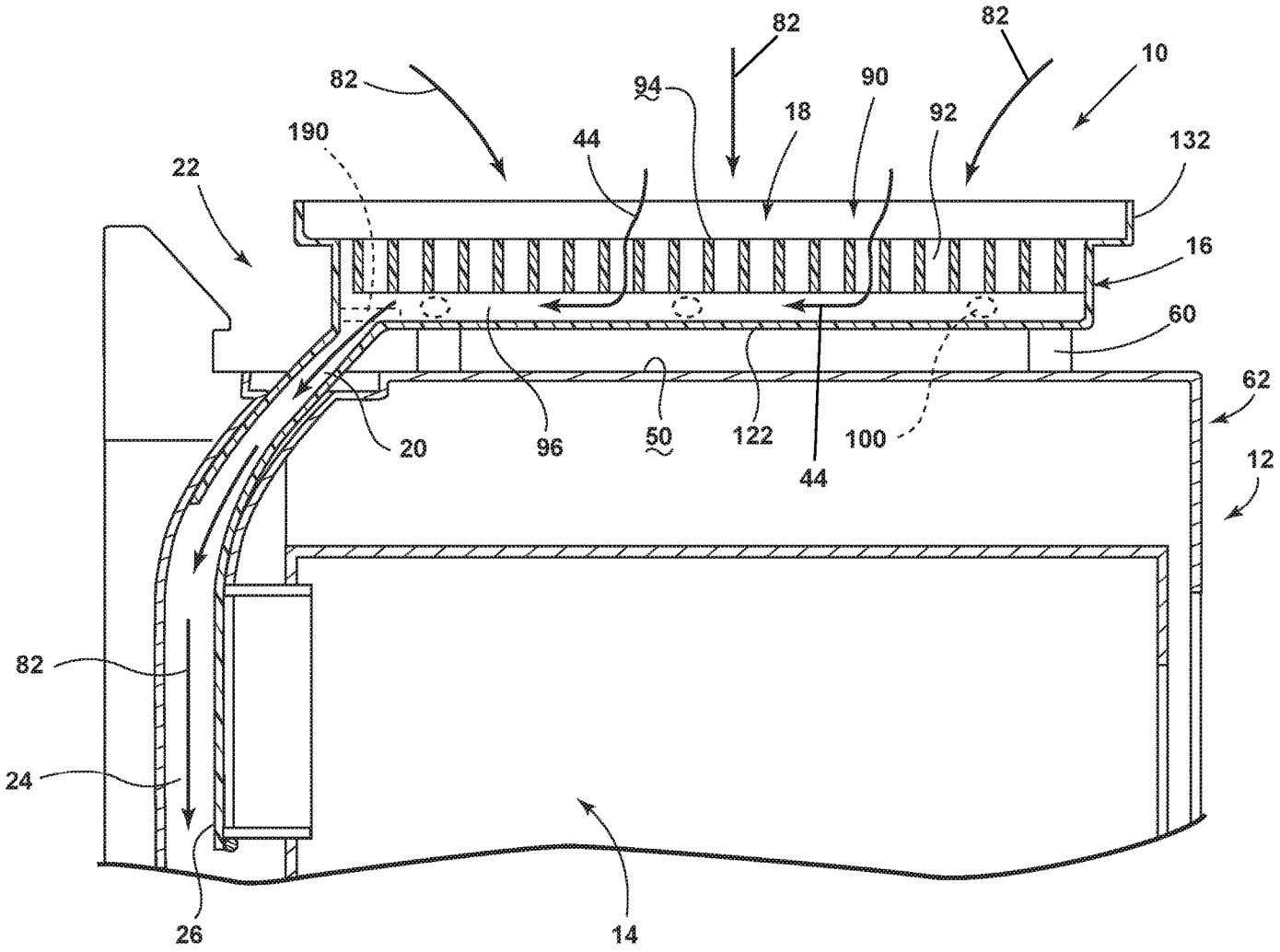
FIG. 6 is a cross-sectional view of an aspect of the external accessory attachment shown in the engaged position and the drying appliance in the activated state.
Figure 7:
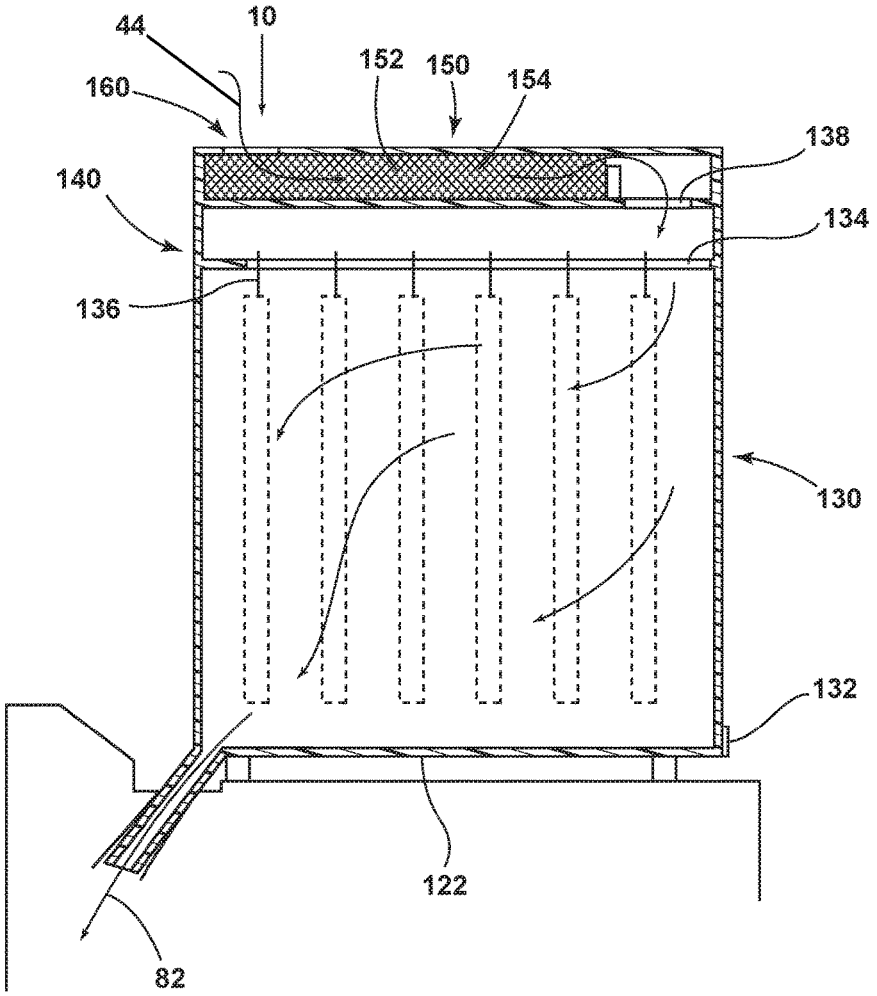
FIG. 7 is a cross-sectional view of an aspect of the external accessory attachment exemplifying a hanging clothing configuration and a conditioning space configuration.
Figure 8:
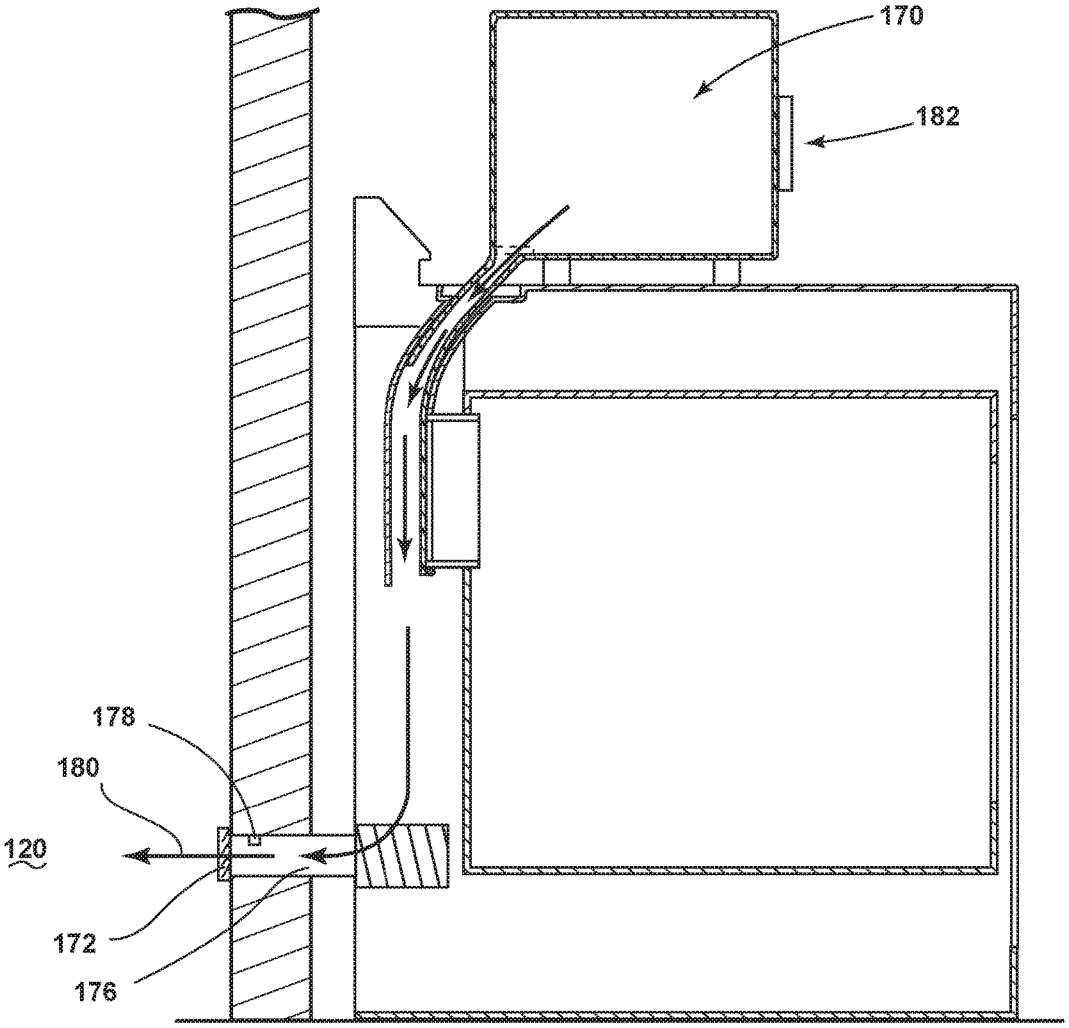
FIG. 8 is a cross-sectional view of an aspect of the external accessory attachment incorporating an airflow monitor.

Referring now to FIGS. 6-8, the external accessory attachment 10 can include a plurality of configurations and subassemblies 90 that can be coupled with the housing 16 to provide for a variety of functions that can be used through use of the external accessory attachment 10. The housing 16 for the external accessory attachment 10 can include a plurality of airflow channels 92 that are each in communication with the suction attachment 20. The upper surfaces 94 of the plurality of airflow channels 92 provide a substantially planar space onto which various items can be placed for drying. This upper surface 94 can be used to dry items that may not be desirable to place inside the rotating drum 14 of the drying appliance 12. Such horizontal drying items can include, but are not limited to, shoes, gloves, scarves, delicate items, toys, and other similar items that may not be desirable to be placed within the rotating drum 14. The upper surface 94 can define a plurality of airflow channels 92 that are substantially small in nature to allow for drying of relatively small items that may have at least a potential to be lost within the rotating drum 14 of the drying appliance 12. A mesh member can be placed on top of the airflow channels 92 to minimize the size of the spaces through which the accessory air 44 can enter the suction attachment 20 and go into the airflow path 24 of the drying appliance 12. Below the airflow channels 92, a horizontal delivery channel 96 can be positioned to allow for movement of accessory air 44 below the airflow channels 92 and into the suction attachment 20.

Referring again to FIGS. 6-8, one or more dedicated heating elements 100 can be positioned within the drying space 18 or within the airflow and/or delivery channels 92, 96. Such heating elements 100 can take the form of resistive heating elements 100, lightbulbs, heating filaments and other similar heat-emitting fixtures that can be disposed within the housing 16 of the external accessory attachment 10. These heating elements 100 can be positioned between or under the various airflow channels 92 and/or within the delivery channel 96 such that heat radiating from the heating element 100 can be transferred to the item being dried on the upper surface 94 of the airflow channels 92. These heating elements 100 can be coupled to the electrical system of the drying appliance 12 or can be coupled to a separate electrical outlet distal from the drying appliance 12, such as a wall outlet. The external accessory attachment 10 can include a battery compartment where batteries can be installed to operate the heating element 100 of the external accessory attachment 10 during use.

The external accessory attachment 10 may include separate heating elements 100. Typically, drying appliances 12 have a plurality of heat settings that range from high heat to a fluff setting that may deactivate a heater 110 of the drying appliance 12. This heater 110 of the drying appliance 12 is typically positioned upstream of the filter slot 42, and the rotating drum 14 within the airflow path 24 such that process air 112 moving through the filter has already been heated through the heater 110 of the drying appliance 12. But when the external accessory attachment 10 is installed in the engaged position 22 within the filter slot 42, air is substantially prevented from flowing through portions of the airflow path 24 upstream of the filter slot 42. Accordingly, no process air 112 or little process air 112 passes across the heater 110 of the drying appliance 12.

As such, the external accessory attachment 10 may simply be used in conjunction with a fluff setting or no heat setting of the drying appliance 12. Alternatively, a separate heating element 100 within the housing 16 of the external accessory attachment 10 can be provided in order to heat the accessory air 44 passing through the drying space 18.

Referring again to FIGS. 1-8, according to the various embodiments, the drying attachment in the form of the external accessory attachment 10 is configured for external use in conjunction with a front load drying appliance 12 having an externally accessible and removable filter member 40. The drying attachment selectively replaces the filter member 40 during operation of the drying accessory attachment 10. The drying accessory attachment 10, in the form of the external accessory attachment 10, includes a housing 16 that at least partially defines the drying space 18. The drying space 18 is in communication with an exterior 120 of the housing 16 and also an exterior 120 of the drying appliance 12. The suction attachment 20 having an integral blocking flange 26 extends from a bottom 122 of the housing 16. The suction attachment 20 is in communication with the drying space 18. The suction attachment 20 is adapted for selective communication with an external blower 80 to define an engaged position 22. The external blower 80 in the engaged position 22 directs a flow of accessory air 44 from the exterior 120 of the housing 16, through the drying space 18 in the suction attachment 20 toward the external blower 80. As discussed above, the external blower 80 is typically in the form of the blower 80 of the drying appliance 12 that is disposed within the airflow path 24 of the drying appliance 12.

Referring again to FIGS. 6-8, the external accessory attachment 10 can include various subassemblies 90 that can be selectively attached to the housing 16 for providing a variety of functionalities to the external accessory attachment 10. Referring to FIG. 7, a hanging clothes attachment 130 can be coupled with the housing 16 of the external accessory attachment 10. In such an embodiment, the hanging clothes attachment 130 can be seated within, rest on or within an outer lip 132 of the housing 16, such that the hanging clothes attachment 130 extends upward from the upper surface 94 of the plurality of airflow channels 92 disposed within the housing 16 of the external accessory attachment 10. Within the hanging clothes attachment 130, one or more horizontally extending bars 134 can be adapted to receive one or more hangers 136. These hangers 136, which typically have clothes hung on them, can be positioned within the drying space 18 defined by the housing 16 and the hanging clothes attachment 130.

Referring again to FIG. 7, within the hanging clothes attachment 130, an air inlet 138 positioned proximate the top area 140 of the hanging clothes attachment 130 allows for the entry of accessory air 44 to be moved into the drying space 18. This accessory air 44 is directed toward, around and through the clothes disposed in a hanging fashion within the drying space 18. The accessory air 44 is then moved toward the suction attachment 20 for delivery into the airflow path 24 of the drying appliance 12. In this manner, certain clothes can be cared for within the drying space 18 defined within the hanging clothes attachment 130. This arrangement is particularly suitable for clothes that should remain hanging during care, such as sport coats, dresses, slacks, and other items that typically may be dry-clean only or preferably dry-cleaned.

Referring again to FIG. 7, a secondary housing 150 can also be coupled to the housing 16 or to the hanging clothes attachment 130. In such an embodiment, the secondary housing 150 defines a conditioning space 152. Within this conditioning space 152, a conditioning material 154 can be disposed within the conditioning space 152. This conditioning material 154 can be in the form of a variety of different types of treating chemistries, including a fragrance material, fabric conditioner, static removing material, or other similar material that can be disposed within the conditioning space 152. Accessory air 44 entering the secondary housing 150 can be moved past or through the conditioning material 154 such that the accessory air 44 is conditioned as it moves through the drying space 18. It is contemplated that the secondary housing 150 can be used in conjunction with the housing 16 and/or the hanging clothes attachment 130 to allow for the conditioning of various items disposed within the drying space 18.

Referring again to FIG. 7, the secondary housing 150 can be positioned on top of the housing 16 and in engagement with the outer lip 132 of the housing 16. The secondary housing 150 can also be located proximate the top area 140 of the hanging clothes attachment 130. When positioned on the hanging clothes attachment 130, the conditioning inlet 160 of the secondary housing 150 can allow for the movement of accessory air 44 past the conditioning material 154 and to the air inlet 138 in the top area 140 of the hanging clothes attachment 130 that allows for the delivery of the accessory air 44 substantially through the drying space 18. It is contemplated that the housing 16, the secondary housing 150 and the hanging clothes attachment 130 are each adapted to allow for the flow of accessory air 44 substantially through the entire drying space 18 of the external accessory attachment 10.

Referring now to FIG. 8, the external accessory attachment 10 can include an airflow monitor 170 that is disposed in communication with the blower 80 of the airflow path 24 of the drying appliance 12. In such an embodiment, the airflow monitor 170 can also be in communication with the air outlet 72 of the airflow path 24. During operation of the drying appliance 12, the airflow monitor 170 can determine the speed at which the blower 80 is operating. This speed, in conjunction with the distance between the air outlet 72 and the external baffle 172 through which the process air 112 is delivered to the environment can also be monitored. A particular speed of the blower 80 typically results in a certain volume of air being moved out of the air outlet 72 and through the external baffles 172 within a particular amount of time.

Referring again to FIG. 8, during operation of the drying appliance 12, various amounts of lint and other particulate material may accumulate within a duct 176 extending between the air outlet 72 and the external baffles 172. This particulate matter can decrease the amount of process air 112 that is able to move through this duct 176. The airflow monitor 170, having a sensor 178 positioned proximate the air outlet 72 and/or the external baffles 172, measures this velocity 180 of process air 112. Where the velocity 180 of process air 112 is below a velocity 180 indicative of a particular blower speed, the airflow monitor 170 can activate an alert 182 to the user of the drying appliance 12 that notifies the user that there may be an obstruction within a portion of the duct 176 of the airflow path 24. This airflow monitor 170 can be disposed within a portion of the housing 16 that can be used whenever the external accessory attachment 10 is placed in the engaged position 22. It is also contemplated that the airflow monitor 170 can be a separate accessory attachment 10 and can be installed within the filter slot 42.

Figure 9:
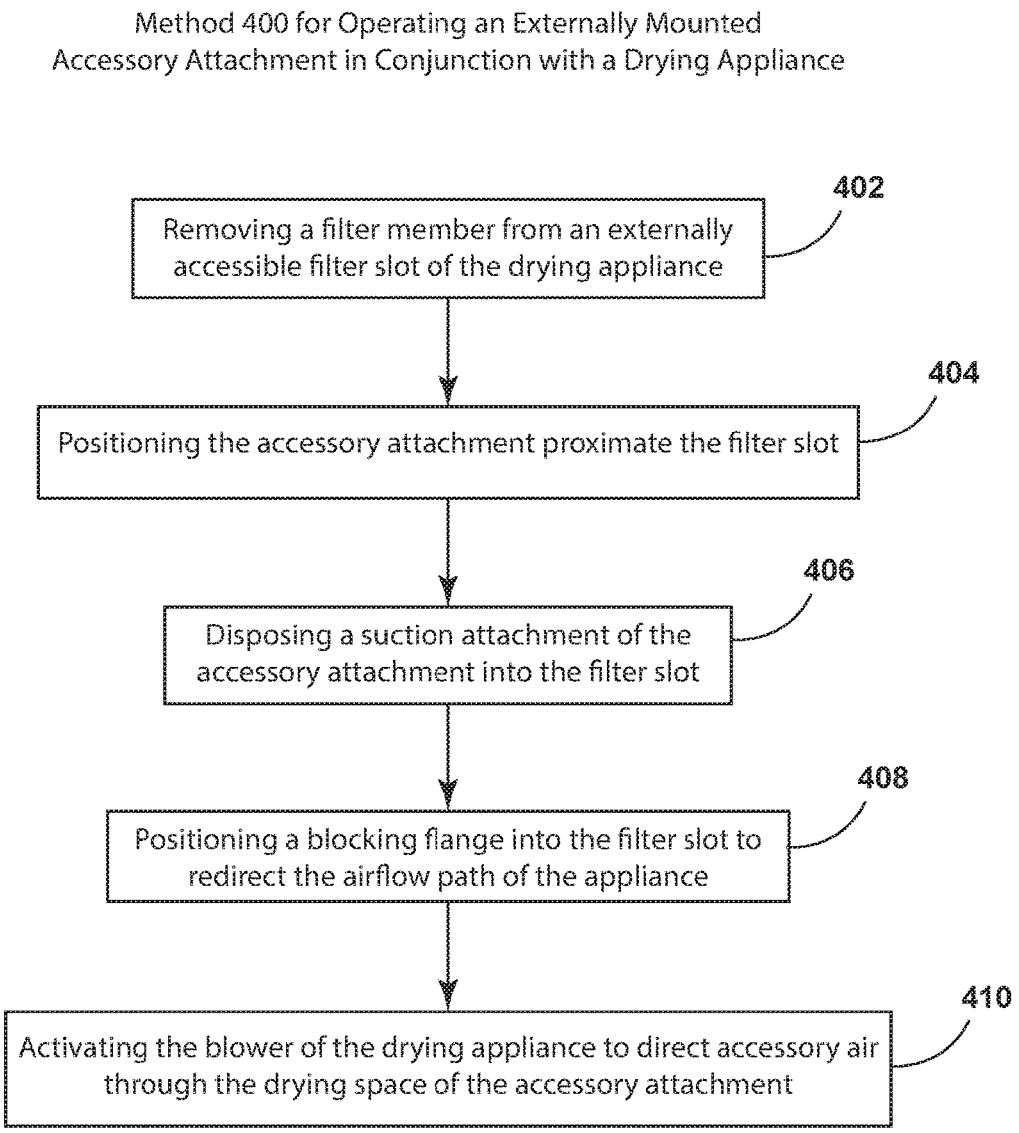
FIG. 9 is a schematic flow diagram illustrating a method of operating an externally mounted drying attachment in conjunction with a drying appliance.

FIG. 9 illustrates a method 400 for operating an externally mounted accessory attachment 10 in conjunction with the drying appliance 12. According to the method 400, a filter member 40 can be removed from an externally accessible filter slot 42 (step 402). This filter slot 42 is in communication with an airflow path 24 of the drying appliance 12. Once the filter member 40 is removed, the drying accessory attachment 10 can be positioned proximate the filter slot 42 (step 404). The drying accessory attachment 10 includes the drying space 18 that is in communication with the suction attachment 20 that extends into the filter slot 42. The suction attachment 20 is then disposed into the externally accessible filter slot 42 of the drying appliance 12 to define an engaged position 22 (step 406). In the engaged position 22, the drying space 18 is placed in communication with the airflow path 24 of the drying appliance 12. The blocking flange 26 is also positioned within the filter slot 42 (step 408). The blocking flange 26 in the engaged position 22 serves to redirect the airflow path 24 of the drying appliance 12 to be through the drying space 18 and through an air outlet 72 of the drying appliance 12. In this manner, the accessory air 44 is directed through the drying space 18 and into the airflow path 24, rather than through an air inlet 138 of the drying appliance 12. The blower 80 of the drying appliance 12 can then be activated to direct accessory air 44 through the drying space 18 (step 410). In this manner, the accessory air 44 is delivered from an area external of both the drying accessory attachment 10 and the drying appliance 12 and through the drying space 18, the suction attachment 20 and out the air outlet 72 of the drying appliance 12 through the airflow path 24.

Referring again to FIGS. 1-9, the engaged position 22 of the suction attachment 20 serves to redirect the airflow path 24 to bypass the air inlet 138 and the rotating drum 14. In this manner, the airflow path 24 enters the drying appliance 12 via the suction attachment 20 and the filter slot 42. Additionally, the drying appliance 12 includes an operable front door 52 that is operable between open and closed positions 54, 56. The rotating drum 14 is generally inaccessible in the closed position 56. A user can position the drying accessory attachment 10 and insert the suction attachment 20 into the externally accessible filter slot 42 while the front door 52 is in the closed position 56. As discussed above, the external accessory attachment 10 is positioned on the top surface 50 of the drying appliance 12, such that there is no need to access the rotating drum 14 of the drying appliance 12 in order to place the external accessory attachment 10 in the engaged position 22.

The external accessory attachment 10 can be used in conjunction with after-market drying appliances 12. It can also be used in conjunction with new drying appliances 12, where these drying appliances 12 include a top mounted and externally accessible filter member 40 that can be removed from a filter slot 42. These dryers can be heating dryers, heat pump dryers, and other similar drying appliances 12. The attachment of the external accessory attachment 10 with the filter slot 42 generates a suction 82 through the drying space 18. This suction 82 draws the accessory air 44 through the drying space 18 such that the accessory air 44 acquires moisture from the articles being dried within the drying space 18. This moisture can then be delivered through the remainder of the airflow path 24 and through the air outlet 72 of the airflow path 24. The external accessory attachment 10 can include a separate accessory filter member 190 that serves to collect lint and other particulate matter that may be collected within the accessory air 44 during use of the external accessory attachment 10. This accessory filter member 190 can be cleaned after use of the external accessory attachment 10 or can be separately removable from the external accessory attachment 10 for cleaning during use or between uses without the need for disengaging the external accessory attachment 10 from the filter slot 42.

The housing 16 of the external accessory attachment 10 can be made of various materials that can include, but are not limited to, plastic, metal, composite, various polymers, ceramic, combinations thereof, and other similar materials that allow for the easy manipulation, carrying and positioning of the external accessory attachment 10 within the filter slot 42 of the drying appliance 12.

The suction attachment 20 can be a rigid member that is slidably inserted into the filter slot 42 as the external accessory attachment 10 is placed on the top surface 50 of the drying appliance 12. The suction attachment 20 can be a substantially flexible section of duct 176 that can be slidably inserted into the filter slot 42. In such an embodiment, the blocking flange 26 may be an integral portion of the suction attachment 20, or can be a separate rigid member that is inserted with the suction attachment 20 to redirect the flow of the airflow path 24 within the drying appliance 12. Where the suction attachment 20 is a flexible member, the external accessory attachment 10 can be placed in the top surface 50 of the drying appliance 12. The suction attachment 20 can then be manipulated using the flexible configuration of the suction attachment 20 to be separately inserted within the filter slot 42 to define the engaged position 22 of the external accessory attachment 10. The rigid blocking flange 26 can be attached to the flexible suction attachment 20 or can be a separate member that is inserted before or after the suction attachment 20 to redirect the airflow path 24 to define the engaged position 22.

It will be understood by one having ordinary skill in the art that construction of the described device and other components is not limited to any specific material. Other exemplary embodiments of the device disclosed herein may be formed from a wide variety of materials, unless described otherwise herein.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. An external accessory attachment for a drying appliance, the accessory attachment comprising:

an attachment housing defining a drying space;

a suction attachment extending from the attachment housing, wherein the suction attachment is selectively disposed within a filter slot of the drying appliance, wherein the suction attachment accepts airflow of a blower for the drying appliance; and a flange of the suction attachment, wherein the flange redirects an airflow path of the drying appliance through the attachment housing and the suction attachment.

2. The external accessory attachment of claim 1, wherein the flange is a blocking flange that is integral with the suction attachment, wherein the blocking flange redirects the airflow path of the drying appliance through the attachment housing and the suction attachment.

3. The external accessory attachment of claim 1, wherein the suction attachment and the flange selectively replace a filter member of the airflow path.

4. The external accessory attachment of claim 1, wherein the suction attachment and flange are selectively inserted through the filter slot defined within an exterior surface of the drying appliance.

5. The external accessory attachment of claim 1, wherein the suction attachment and the flange can be inserted without opening a front door of the drying appliance.

6. The external accessory attachment of claim 1, wherein the attachment housing includes a plurality of airflow channels that are each in communication with the suction attachment.

7. The external accessory attachment of claim 1, wherein the attachment housing includes a hanging clothes attachment.

8. The external accessory attachment of claim 1, wherein the attachment housing includes a secondary housing that defines a conditioning space, wherein the conditioning space selectively receives a conditioning material.

9. The external accessory attachment of claim 7, wherein the hanging clothes attachment is selectively disposed within an outer lip of the attachment housing.

10. The external accessory attachment of claim 1, wherein the external accessory attachment includes a dedicated heating element.

11. The external accessory attachment of claim 1, wherein the drying space includes an air flow monitor in communication with a blower of the airflow path.

12. A drying attachment for external use in conjunction with a front load drying appliance having an externally accessible and removable filter member, the drying attachment selectively replacing the filter member during operation, the drying attachment comprising:

an attachment housing defining a drying space; and a suction attachment having an integral blocking flange extending from a bottom of the attachment housing, the suction attachment allowing airflow through the drying space; wherein the suction attachment channels air through the drying space and towards a blower disposed in the front load drying appliance, and wherein the airflow is generated by the blower.

13. The drying attachment of claim 12, wherein the attachment housing includes a hanging clothes attachment and a dedicated heating element.

14. The drying attachment of claim 12, wherein the attachment housing includes a secondary housing that defines a conditioning space, wherein the conditioning space selectively receives a conditioning material.

15. The drying attachment of claim 14, wherein the secondary housing is selectively seated within an outer lip of the attachment housing.

16. The drying attachment of claim 12, wherein the drying space includes an air flow monitor capable of measuring air flow through the drying space.

17. A method of operating an externally mounted drying attachment in conjunction with a drying appliance, the method comprising steps of:

removing a filter member from an externally accessible filter slot, the filter slot being in an airflow path of the drying appliance;

positioning the drying attachment proximate the filter slot, the drying attachment having a drying space and a suction attachment;

disposing the suction attachment into the filter slot in the airflow path;

positioning a blocking flange to redirect an airflow path of the drying appliance to be through the drying space of the drying attachment and through an air outlet of the drying appliance to define an engaged position of the suction attachment; and activating a blower of the drying appliance to direct air through the drying space of the drying attachment and the suction attachment and out the air outlet via the airflow path of the drying appliance.

18. The method of claim 17, wherein the airflow path in an unengaged position of the suction attachment is directed through the drying appliance from an air inlet, through a rotating drum, through the filter slot and out of the drying appliance through the air outlet, and wherein the blocking flange is integral with the suction attachment.

19. The method of claim 18, wherein the engaged position of the suction attachment redirects the airflow path to bypass the air inlet and the rotating drum such that the airflow path enters the drying appliance via the suction attachment and the filter slot.

20. The method of claim 18, wherein the drying appliance includes an operable front door that is operable between an open position and a closed position, the rotating drum being inaccessible in the closed position, wherein the steps of positioning the drying attachment and disposing the suction attachment into the filter slot are capable of performed while the operable front door of the drying appliance is in the closed position.

* * * * *